US006149507A

United States Patent [19]

Lee et al.

[11] Patent Number: 6,149,507

[45] Date of Patent: Nov. 21, 2000

[54] WAFER POLISHING APPARATUS HAVING MEASUREMENT DEVICE AND POLISHING METHOD

[75] Inventors: Sang-seon Lee; Jeong-kon Kim, both of Kyungki-do, Rep. of Korea

[73] Assignee: Samsung Electronics Co., Ltd., Suwon, Rep. of Korea

[21] Appl. No.: 09/111,746

[22] Filed: Jul. 8, 1998

[30] Foreign Application Priority Data

Jul. 10, 1997 [KR] Rep. of Korea ..... 97-32127

[51] Int. Cl.[7] ..... B24B 1/00

[52] U.S. Cl. ..... 451/66; 451/41; 451/6; 451/287

[58] Field of Search ..... 451/6, 41, 66, 451/67, 287, 285, 289

[56] References Cited

U.S. PATENT DOCUMENTS

| | | | |
|---|---|---|---|
| 5,498,199 | 3/1996 | Karlsrud et al. | 451/289 |
| 5,649,854 | 7/1997 | Gill | 451/290 |
| 5,655,954 | 8/1997 | Oishi et al. | 451/67 |
| 5,658,183 | 8/1997 | Sandhu et al. | 451/6 |
| 5,679,055 | 10/1997 | Green et al. | 451/41 |
| 5,679,059 | 10/1997 | Nishi et al. | 451/41 |
| 5,865,901 | 2/1999 | Yin et al. | 134/2 |
| 5,904,611 | 5/1999 | Takahashi et al. | 451/41 |
| 6,012,966 | 1/2000 | Ban et al. | 451/8 |

*Primary Examiner*—David A. Scherbel
*Assistant Examiner*—George Nguyen
*Attorney, Agent, or Firm*—Jones Volentine, LLP

[57] ABSTRACT

A polishing method and apparatus for a semiconductor wafer includes a loading section having a loading platform for mounting a loading cassette, and a loading robot arm for transferring a wafer from the loading cassette. The apparatus includes a standby stage having a pre-polishing stand on which the wafer is placed, and a post-polishing stand for holding the wafer after polishing, and a polishing table on which a polishing process is performed. A wafer moving device transfers the wafer from the pre-polishing stand to the polishing table and back to the post-polishing stand. An unloading section includes an unloading platform for mounting an unloading cassette, and an unloading robot arm for transferring the wafer to the unloading cassette. A measurement device, proximal to the unloading stage, analyzes a polishing state of the wafer and then a cleaning device cleans the wafer after the wafers are analyzed.

10 Claims, 3 Drawing Sheets

WAFER POLISHING APPARATUS HAVING MEASUREMENT DEVICE AND POLISHING METHOD

BACKGROUND

1. Field of the Invention

The present invention relates to a wafer polishing apparatus having a measurement device and a polishing method using the apparatus for the fabrication of semiconductor devices. More particularly, the present invention relates to a wafer polishing apparatus having a measurement device for determining the polishing state of a wafer before cleaning the wafer, and the associated polishing method.

2. Description of the Related Art

The patterns formed on a semiconductor wafer are growing more and more intricate as semiconductor devices achieve greater functionality using highly miniaturized components in greater densities on the chip. Such devices utilize multi-layered circuit patterns to connect the individual components. Step-height differences between deposited layers of adjacent unit cells are reduced using Chemical Mechanical Polishing (CMP) techniques.

As shown in the schematic plan diagram in FIG. 1, the conventional CMP process is executed by performing a polishing process inside a polishing apparatus 10, performing a cleaning process inside a separate chemical cleaning apparatus 12, and then analyzing the polished state of the wafer inside a separate measurement apparatus 14.

A grinding surface is formed on the upper surface of a rotatable polishing table 16 inside the polishing apparatus 10. Nozzles (not shown), located a predetermined distance above the upper surface of the polishing table 16, spray a grinding solution, i.e., a slurry, onto the polishing table 16. Near the polishing table 16 is located a standby stage 18. The standby stage 18 is annular and is turned in equal increments. On the standby stage 18 are stands 22 and 24 for placing wafers on the standby stage 18. In the conventional polishing apparatus shown in FIG. 1 five pre-polishing stands 22 and five post-polishing stands 24 are alternately installed on the standby stage 18. Wafers to be polished are placed on the pre-polishing stands 22, and the polished wafers are placed on the post polishing stands 24 after completion of the polishing process.

In addition, a rinsing device 20 is included for rinsing the wafers using deionized water after the wafers are polished. The rinsing device is disposed inside the annulus of the standby stage 18.

On one side near the standby stage 18, there is a loading section which includes one or more loading platforms 28 for mounting one or more loading cassettes. A loading cassette holds a plurality of wafers to be polished. The side of each wafer to be polished is termed the front side. The loading section includes a loading robot arm 27 for transferring a wafer from a loading cassette on the loading platform 28 to a pre-polishing stand 22 of the standby stage 18. A wafer is placed upside down on a pre-polishing stand 22 such that the front side of the wafer contacts the surface of the pre-polishing stand 22.

On another side of the standby stage 18, there is a unloading section which includes an unloading robot arm 25 and one or more unloading platforms 26 for mounting one or more unloading cassettes. The unloading robot arm 25 transfers a wafer on the post-polishing stand 24 of the standby stage 18 to a specific position in an unloading cassette on an unloading platform 26.

In addition, a wafer moving device is positioned above the standby stage 18. As shown in FIG. 2, a wafer moving device 30 has a body 32 which is cylindrical and five spindles 34 connected to the body 32. Each spindle 34 has a wafer carrier 36 attached. The wafer moving device 30 is movable back and forth, and up and down. Each spindle 34 can be rotated about its own long axis, and can be translated from near the outside edge of the device body 32 cylinder radially to a position near the center of the device body 32 cylinder and back. That is, the spindles 34 are rotatable and radially reciprocating. A wafer is temporarily fixed to a wafer carrier 36 by applying suction to the back side of the wafer.

Inside a conventional chemical cleaning apparatus 12, there are a container (not shown) having a certain amount of chemicals and a dryer (not shown) for removing liquid collected on the wafers during the cleaning process. In using the conventional, separate cleaning apparatus 12, a cassette of wafers is transported to the chemical cleaner 12 after the polishing process.

After cleaning the wafers in the chemical cleaning apparatus 12, the wafers are transported to the separate measurement apparatus 14, and analyzed. In the measurement apparatus 14, the thickness of the outermost layer of the front side of the wafer is optically measured.

The operation of these conventional apparatuses is described next. In the polishing apparatus 10, five wafers of the plurality of wafers loaded in the loading cassette on the loading platform 28 are transferred front side down, one by one, to the pre-polishing stands 22 using a reciprocating movement of the loading robot arm 27. After each wafer is placed front side down on a pre-polishing stand 22, the standby stage 18 is turned an equal increment to bring the next pre-polishing stand into the operating range of the loading robot arm 27, i.e., into the work envelope of the loading robot arm 27.

Then, the wafer moving device 30 above the standby stage 18 descends, and the wafer carriers 36 of the wafer moving device 30 use suction to temporarily fix all five wafer carriers simultaneously to the back sides of the corresponding five wafers on the five pre-polishing stands 22. Then, the wafer moving device 30 moves upward, and then horizontally so as to be positioned above the polishing table 16 with all five wafers, front side down. The wafer moving device then again descends so that the surface of the polishing table 16 closely contacts the front surfaces of the wafers. Next, the polishing table 16 rotates while the spindles 34 simultaneously rotate and reciprocate radially. At the same time, a slurry grinding solution is sprayed on the upper surface of the polishing table 16 from the nozzles (not shown) above the polishing table 16. The grinding surface formed on the upper side of the polishing table 16 is brought into contact with the front surface of the wafers such that the front side of the wafer is polished by the chemical and physical (mechanical) mechanisms of the polishing process.

During the polishing process different pressures may be generated between the wafer and the grinding surface formed on the upper surface of the polishing table 16. The different pressures result in different thicknesses among the outermost layers of the different polished wafers. The thickness of the outermost layer is later analyzed in a measurement apparatus as described below.

After the polishing is completed according to a predetermined schedule, the wafer moving device 30 ascends and moves horizontally to carry the wafers to the rinsing device 20. There, the polished wafers are rinsed in de-ionized water.

Then, the rinsed wafers are transferred to the five post-polishing stands 24 of the standby stage 18 by the wafer moving device 30.

The wafers on the post-polishing stands 24 of the standby stage 18 are loaded one by one onto an unloading cassette on an unloading platform 26 by the repeated, reciprocating movement of the unloading robot arm 25, and by the equal incremental turns of the standby stage 18 bringing the next post-processing stand into the work envelope of the unloading robot arm 25.

Then, the wafers in an unloading cassette on an unloading platform 26 are transported to the chemical cleaning apparatus 12 by an automatic transporting device (not shown), and those wafers are put into the container (not shown) inside the chemical cleaning apparatus 12 to be cleaned and then dried in a dryer (not shown).

The wafers passing through the chemical cleaning apparatus are finally transported into the measurement apparatus 14 for the analysis process to measure the thickness of the outermost layer of the front side of each polished wafer. Thereafter, if a polished wafer is found to have an abnormal thickness for the outermost layer, the wafer is again input into the the polishing apparatus 10 so as to go through the polishing process another time.

In addition to the normal polishing just described, the polishing apparatus also undergoes a calibration check. Before operating on wafers containing actual semiconductor devices, dummy wafers are loaded into the polishing apparatus 10. The dummy wafers then pass through the polishing process and the cleaning process. Then, the polishing apparatus is checked for malfunctions by carrying out the analysis process in the measurement apparatus 14. In the case that a malfunction of the polishing apparatus 10 is found, the operational conditions in the polishing apparatus 10 are readjusted. Hence the polishing apparatus is calibrated.

During both normal operations and calibration, wafers are removed from the polishing apparatus and cleaned before undergoing analysis in the measurement apparatus. Checking for abnormalities after performing the cleaning process causes a loss of time. However, if the analysis process were performed right after the polishing process inside the polishing apparatus without cleaning first, the abnormal polishing could be detected and corrected earlier, thus saving time. Also, since the conventional polishing apparatus, chemical cleaning apparatus, and measurement apparatus are separate, a loss of time is caused during transportation of the wafers between these apparatuses. That is, extra time is required to transport the wafers from the polishing apparatus to the chemical cleaning apparatus, and from the chemical cleaning apparatus to the measurement apparatus.

Similarly, when the polishing apparatus is calibrated with the dummy wafers using the conventional apparatuses, the dummy wafers are measured after the cleaning process inside the chemical cleaning apparatus, thereby causing a loss of time. If calibration is also performed by passing wafers immediately into the measurement apparatus, skipping the cleaning process, a great savings of time can be achieved.

Therefore what is needed is a polishing apparatus that will perform measurements on the outermost layer of the front side of a wafer, or calibration to detect and correct malfunctions, before cleaning in a chemical cleaning device. Also needed is a polishing device that is not separate from a cleaning device and a measurement device, to avoid delays incurred as wafers are transported among separate devices.

SUMMARY OF THE INVENTION

An object of the present invention is to provide a wafer polishing apparatus and method for avoiding the loss of time caused by carrying out the analysis process in a separate apparatus, after the conventional chemical cleaning process, during the fabrication of semiconductor devices.

To achieve this and other objects and advantages of the present invention, a polishing apparatus comprises a loading section having a loading platform for mounting a loading cassette for holding a plurality of unpolished wafers, and a loading robot arm for transferring a wafer from the loading cassette. The apparatus includes a standby stage comprising a pre-polishing stand on which the wafer transferred by the loading robot arm is placed, and a post-polishing stand for holding the wafer after the wafer has been polished. The apparatus includes a polishing table on which a polishing process is performed on a front side of the wafer, and a wafer moving device for transferring the wafer from the pre-polishing stand to the polishing table before polishing, and for transferring the wafer from the polishing table to the post-polishing stand after polishing. An unloading section has an unloading platform for mounting an unloading cassette for holding a plurality of polished wafers, and an unloading robot arm for transferring the wafer from the post-polishing stand to the unloading cassette. A measurement device, proximal to the unloading stage, analyzes a polishing state of the wafer after removing the wafer from the unloading cassette and before cleaning the wafer, and a cleaning device cleans the wafer.

In another aspect of the apparatus of the invention the measurement device comprises a thickness measurement device for indicating a thickness of a specific layer formed on the front side of the wafer, and a particle counter for providing a distribution of particle size found on the front side of the wafer.

In another aspect of the invention, the apparatus further includes a cleaning standby platform, a re-polishing standby platform, and a malfunction standby platform, all proximal to the measurement device.

In another aspect of the invention, the polishing method for the fabrication of semiconductor devices includes unloading a polished wafer from a standby stage in a polishing apparatus to an unloading cassette, analyzing the wafer from the unloading cassette for determining a polishing state, transferring the wafer with a normal polishing state to a cleaning standby cassette, and cleaning the wafer from the cleaning standby cassette.

BRIEF DESCRIPTION OF THE DRAWINGS

The present invention is described with reference to the accompanying drawings in which.

DETAILED DESCRIPTION OF THE PREFERRED EMBODIMENTS

Figure 3:
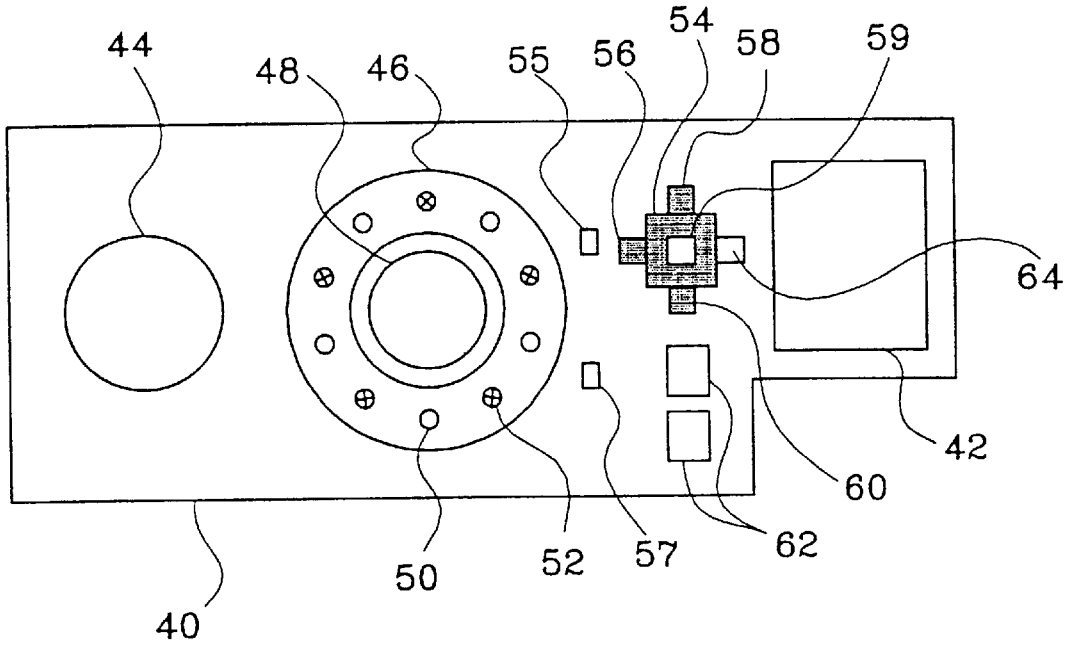
FIG. 3 is a schematic diagram showing one embodiment of the wafer polishing apparatus having the measurement device according to the present invention.

Referring to FIG. 3, a preferred embodiment is described in detail. As in the conventional polisher, inside the polishing apparatus 40, a grinding surface is formed on the upper surface of a rotatable polishing table 44. Also, nozzles (not shown) for spraying slurry as the grinding solution are installed nearby, above the polishing table 44. In addition a standby stage 46 is positioned near the polishing table 44 with pre-polishing stands 50 and post-polishing stands 52, preferably five of each, alternately placed. A pre-polishing stand 50 is for mounting a wafer to be polished and a post polishing stand 52 is for mounting the wafer after going through the polishing process. The standby stage 46 is annular or ring-shaped, and is turned in equal increments through a constant distance. Inside the annular standby stage 46 is installed a rinsing device 48 for rinsing the polished wafers using de-ionized water.

Also, next to the standby stage 46, there is a loading section with one or more loading platforms 62 for mounting one or more loading cassettes, and with a loading robot arm 57. A loading cassette on a loading platform 62 holds the wafers to be polished, and the loading robot arm 57 transfers the wafers one by one from a loading cassette on a loading platform 62 to a pre-polishing stand 50. The loading robot arm 57 places the wafers upside down on the pre-polishing stands such that the front side of the wafer contacts the upper surface of the pre-polishing stand 50.

Figure 1:
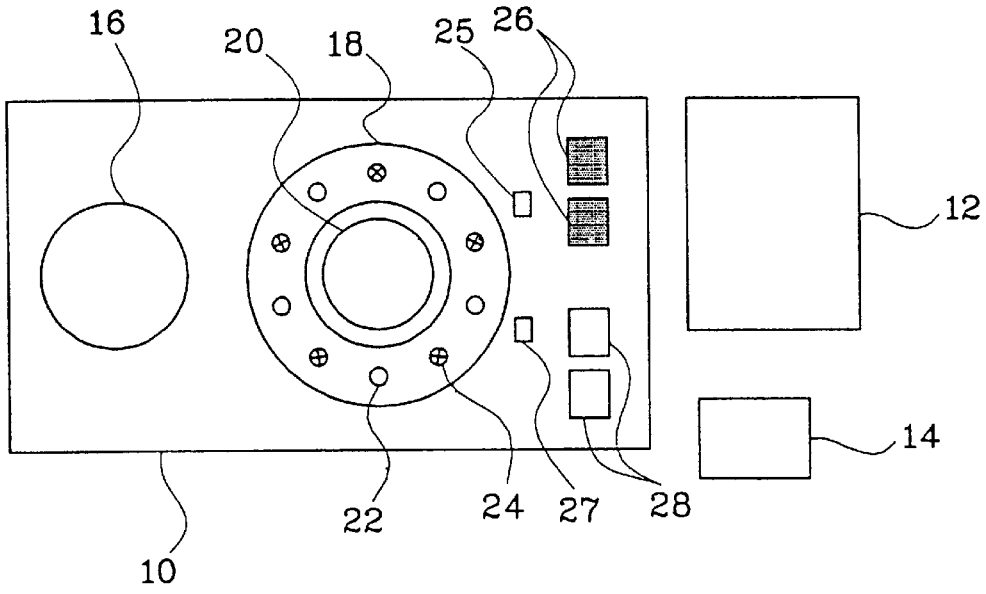
FIG. 1 (PRIOR ART)
FIG. 1 is a schematic diagram of the conventional polishing apparatus, chemical cleaning apparatus, and measurement apparatus.
Figure 2:
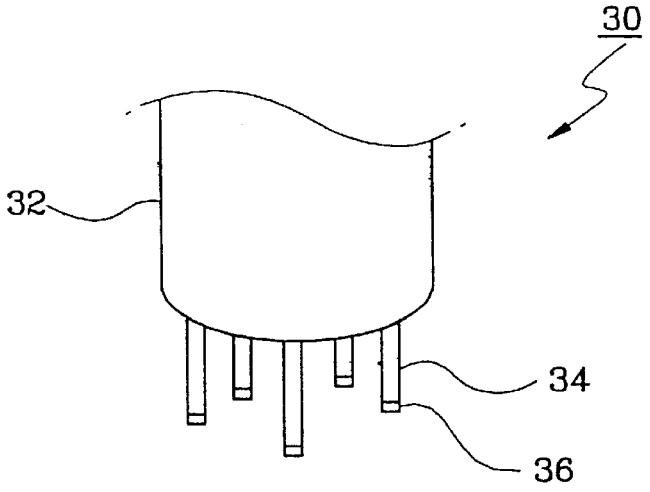
FIG. 2 (PRIOR ART)
FIG. 2 is a schematic view showing the conventional wafer moving device.

As in the conventional polishing apparatus, above and near the upper side of the standby stage 46 is a wafer moving device (30 in FIG. 2). As described previously, the wafer moving device 30 includes a body 32 which is cylindrical, and includes five spindles 34 connected to the body 32. Each spindle 34 has a wafer carrier 36 attached. The wafer moving device 30 is movable back and forth, and up and down. The spindles 34 are rotatable and radially reciprocating. A wafer is temporarily fixed to a wafer carrier 36 by suction applied to the back side of the wafer.

Referring again to FIG. 3, the present invention is further described. Unlike the conventional polishing apparatus, a measurement device 54 and a cleaning device 42 are incorporated within the polishing apparatus 40 of the present invention.

Next to the standby stage 46 is the measurement device 54. The measurement device 54 performs the analysis process on a wafer after it has been polished and removed from a post-polishing stand. In the preferred embodiment, the measurement device optically measures the thickness of the outermost layer on the front side of the wafer placed in the measurement device 54. In some embodiments, the measurement device includes a particle counter to determine the distribution of particle sizes on the polished surface of the front side of the wafer, especially the number of particles having sizes over a certain critical size. In the preferred embodiment the particle counter is disposed nearby but apart from the device that optically measures the thickness.

Between the standby stage 46 and the measurement device 54 is installed a unloading section including an unloading robot arm 55 and an unloading platform 56 for mounting an unloading cassette. Each wafer on a post-polishing stand 52 is transferred to its own position in the unloading cassette on the unloading platform 56 by the unloading robot arm 55.

Close to the measurement device 54 is installed a re-polishing standby platform 60 for mounting a re-polishing standby cassette. The re-polishing standby cassette, a first extra standby cassette, is for holding incompletely polished wafers, i.e., wafers that need to be polished again, as determined by the analysis performed in the measurement device 54. On the opposite side of the measurement device 54 from the re-polishing standby platform 60 is installed a malfunction standby platform 58 for mounting a malfunction standby cassette. The malfunction standby cassette, a second extra standby cassette, is for holding wafers when the polishing process is malfunctioning. Malfunctioning is determined by the measurement device through analysis of the wafer, as, for example, occurs during the calibration of the apparatus.

In the present invention, the loading robot arm 57 not only transfers a wafer from a loading cassette on a loading platform 62 to a pre-polishing stand 50, but also is positioned to transfer a wafer loaded in the re-polishing standby cassette on the re-polishing standby platform 60 to a pre-polishing stand 50. That is, the loading robot arm 57 has a work envelope that encompasses the re-polishing standby cassette on the re-polishing standby platform 60.

According to the present invention, the chemical cleaning device 42 is placed beside the measurement device 54 for cleaning wafers that have been completely and normally polished. In the chemical cleaning device, particles are removed from the front surface of the wafer using chemicals and then the wafer is dried.

In the preferred embodiment, a cleaning standby platform 64 for mounting a cleaning standby cassette is installed between the measurement device 54 and the chemical cleaning device 42. The cleaning standby cassette is a cassette for holding the normal polished wafers which have gone through the analysis process before going through the cleaning process.

In the preferred embodiment, a robot arm 59 is included with the measurement device 54 for transferring the wafers. The measurement robot arm 59 transfers a wafer from the unloading cassette on the unloading platform 56 to a measurement site of the measurement device 54. Based on the results of the measurement, the measurement robot arm 59 transfers the wafer on the measurement site either to the cleaning standby cassette on the cleaning standby platform 64, to the re-polishing standby cassette on the re-polishing standby platform 60, or to the malfunction standby cassette on the malfunction standby platform 58.

The operation of the polishing apparatus 40 according to the present invention is described next. Among a plurality of wafers loaded in the loading cassette on the loading platform 62, wafers are transferred by the loading robot arm 57 one by one, and placed front side down on the pre-polishing stands 50, with the standby stage 46 turning in equal increments after each wafer is transferred. The process is repeated until all pre-polishing stands have wafers or the supply of wafers is depleted. In the preferred embodiment, five wafers are loaded onto the standby stage 46.

Then, the wafer moving device 30 (FIG. 2) descends and the wafer carriers 36 of the wafer moving device 30 attach to the back side of the wafers on the prepolishing stands 50 using suction. Then, the wafer moving device 30 moves horizontally to a position above the upper surface of the polishing table 44, and descends so that the front side of the wafers contact the upper surface of the polishing table 44. The polishing table 44 then rotates, and the spindles 34 rotate while radially reciprocating, at the same time as the nozzles spray a given amount of slurry. Accordingly, the front side of the wafers contacted with the upper side of the polishing table 44 are polished by chemical and physical mechanisms. In the preferred embodiment, the polished wafers are next moved by the wafer moving device 30 to a rinsing device 48 where the wafers are rinsed using de-ionized water. Then, the wafers are transferred to the post-polishing stands 52 of the standby stage 46 by the wafer moving device 30. These steps occur during polishing as in the conventional polishing apparatus. In the preferred embodiment, five wafers are transferred and polished simultaneously by the wafer moving device 30.

Figure 4:
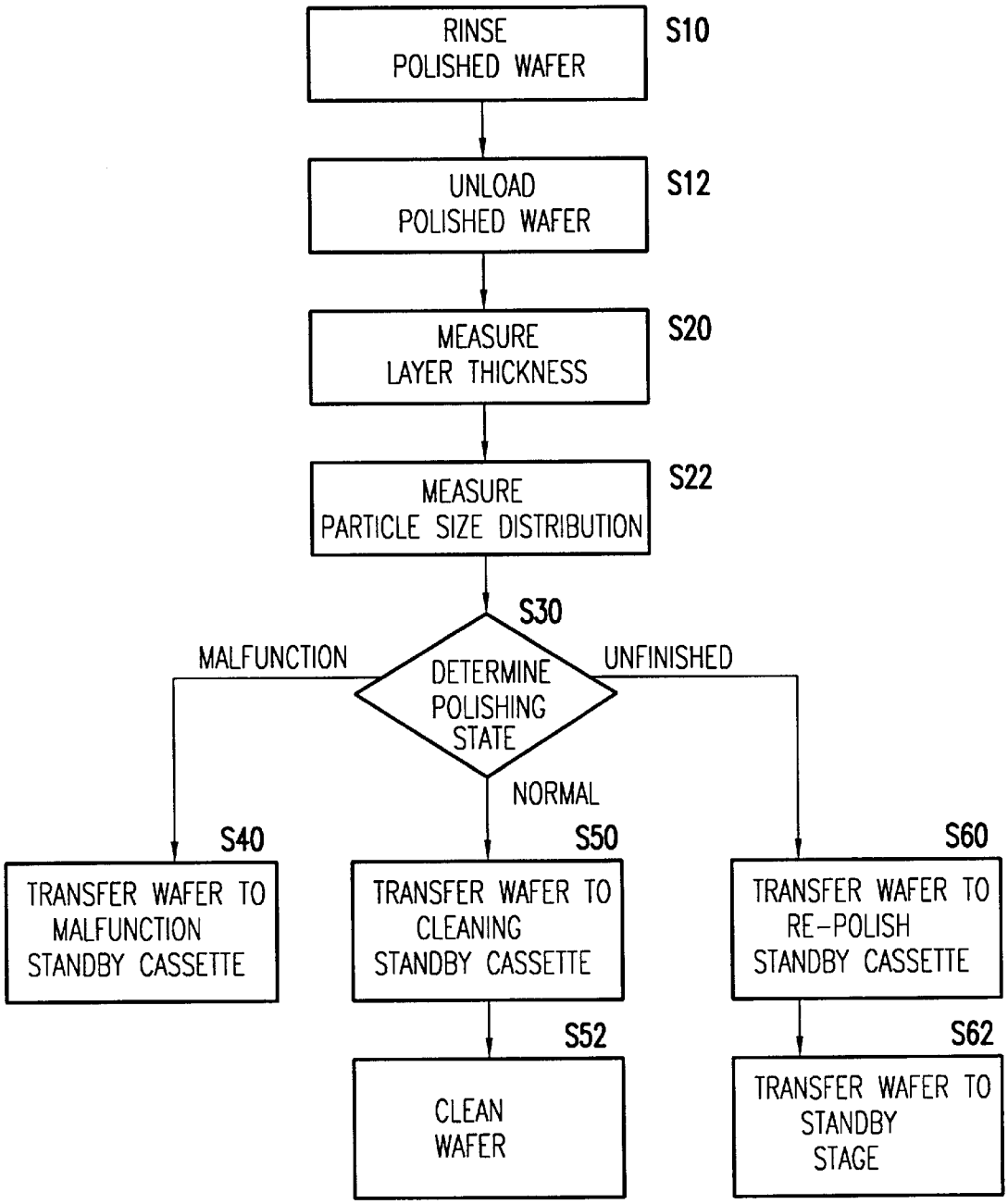
FIG. 4 is a flow diagram of the preferred embodiment of the method according to the present invention.

Referring to FIG. 3 and FIG. 4, the features of the method of the present invention are described. After polishing on the polishing table 44, the polished wafers are rinsed during the rinsing step S10. Then wafers on the post-polishing stands 52 are loaded into the unloading cassette on the unloading platform 56 by the unloading robot arm 55 during the unloading step S12.

Then, the wafers in the unloading cassette are analyzed in the measurement device 54 to determine a polishing state for the wafer. In the preferred embodiment, the wafers are moved to the analysis site of the measurement device 54 by the measurement robot arm 59. In the preferred embodiment, the analysis step includes measuring the thickness of the outermost layer on the polished front side of the wafer, step S20, and measuring the number of particles found on the surface of the front side of the wafer having sizes greater than a critical size, i.e., a particle size distribution, in step S22.

Then the polishing state is determined in step S30 based on the results of the analysis step. In the preferred embodiment, a wafer polishing state is determined to be either in a normal state, or an unfinished state, or a malfunction state. A normal polishing state indicates that polishing is complete and the wafer is ready for cleaning. An unfinished polishing state indicates that the wafer is incompletely polished and should be re-polished before cleaning. A malfunction polishing state indicates that the polishing process is malfunctioning so that the wafers are not suitable for cleaning and that the settings of the polishing apparatus should be changed before further wafers are processed.

Then, in step S50, the wafers which have a normal polishing state are loaded into the cleaning standby cassette on the cleaning standby platform 64. During step S52, the wafers are transferred to and placed in the chemical cleaning device 42, where the contaminants existing on the surface of the wafers are removed using chemicals, and the wafers are dried. According to the present invention, wafers that are not in the normal polishing state are not cleaned.

In the preferred embodiment, the wafers which have an unfinished polishing state are loaded into the re-polishing standby cassette on the re-polishing standby platform 60 by the measurement robot arm 59 during step S60. In this embodiment, the loading robot arm 57 transfers the wafers to the pre-polishing stands 52 of the standby stage 46 during step S62. Thus these wafers are re-polished, i.e., they again go through the polishing process on the polishing table 44.

In the preferred embodiment, the wafers which have the malfunction polishing state are loaded into the malfunction standby cassette on the malfunction standby platform 58 by the measurement robot arm 59 during step S40. The wafers in the malfunction standby cassette are held there for a predetermined time.

When the polishing apparatus 40 is first operated, dummy wafers for calibration are input to the polishing apparatus 40 through a loading cassette mounted on a loading platform 62. In case that the dummy wafers are found to be in a malfunction polishing state after polishing, the operational conditions of the polishing apparatus 40 are readjusted.

Therefore, according to the present invention, an analysis process is carried out in a measurement device 54 right after polishing and before cleaning. When cleaning is suitable, i.e., when a wafer is in the normal polishing state, the cleaning process is performed in sequence in the cleaning device 42 . Thus the cleaning process is not performed unless the measurement process, for example, measuring the thickness of the outermost layer, indicates that the wafer is normal and cleaning is necessary, thereby avoiding a loss of time. Further, when the polishing apparatus is first operated with dummy wafers, a loss of time caused by carrying out a cleaning process is prevented by conducting the calibration analysis immediately after the polishing process. Also, by installing the chemical cleaning device inside the polishing apparatus, the present invention prevents a loss of time caused by the transportation of the wafers between separate pieces of equipment.

While the present invention has been shown and described with reference to the foregoing examples and preferred embodiments, it will be understood by those skilled in the art that other changes in form and detail may be made to them without departing from the spirit and scope of the invention as defined by the appended claims and their equivalents.

What is claimed is:

1. A polishing apparatus for the fabrication of semiconductor devices, comprising:

a loading platform for mounting a loading cassette for holding a plurality of unpolished wafers;

a standby stage comprising a pre-polishing stand dedicated for holding an unpolished wafer, and a post-polishing stand dedicated for holding the wafer after the wafer has been polished;

a loading robot arm, for transferring an unpolished wafer from the loading cassette to the pre-polishing stand of said standby stage;

a polishing table on which a polishing process is performed on a front side of the wafer;

a wafer moving device for transferring the wafer from the pre-polishing stand to the polishing table before polishing, and for transferring the wafer from the polishing table to the post-polishing stand after polishing;

an unloading platform for mounting an unloading cassette for holding a plurality of polished wafers;

a measurement site proximal to the unloading platform, and at which site a polishing state of the wafer is analyzed;

a cleaning device for cleaning the wafer; and robot means for directly transferring a polished wafer from the post-polishing stand of said standby stage to said measurement site via the unloading cassette, whereby the polished wafer is analyzed before it is cleaned.

2. The wafer polishing apparatus of claim 1, further comprising a thickness measurement device for indicating a thickness of a specific layer formed on the front side of a wafer disposed at said measurement site.

3. The wafer polishing apparatus of claim 2, further comprising a particle counter for providing a distribution of particle size found on the front side of the wafer.

4. The wafer polishing apparatus of claim 1, further comprising a cleaning standby platform proximal to the measurement site, for mounting a cleaning standby cassette for holding a plurality of analyzed wafers ready for cleaning by said cleaning device.

5. The wafer polishing apparatus of claim 1, further comprising a re-polishing standby platform proximal to the measurement site, for mounting a re-polishing standby cassette for holding a plurality of analyzed wafers ready for re-polishing.

6. The wafer polishing apparatus of claim 5, wherein the loading robot arm also encompasses said re-polishing platform, and the loading robot arm is for transferring a wafer from the re-polishing standby cassette to the pre-polishing stand of said standby stage.

7. The wafer polishing apparatus of claim 1, further comprising a malfunction standby platform proximal to said measurement site for mounting a malfunction standby cassette for holding a plurality of analyzed wafers indicative of a malfunction in the polishing process.

8. The wafer polishing apparatus of claim 1, further comprising a rinsing device proximal to the standby stage for rinsing the wafer with de-ionized water before transferring the wafer to the unloading cassette.

9. The wafer polishing apparatus of claim 1, further comprising:

a cleaning standby platform proximal to said measurement site, for mounting a cleaning standby cassette for holding a plurality of analyzed wafers ready for cleaning;

a re-polishing standby platform proximal to said measurement site, for mounting a re-polishing standby cassette for holding a plurality of analyzed wafers ready for re-polishing; and a malfunction standby platform proximal to said measurement site, for mounting a malfunction standby cassette for holding a plurality of analyzed wafers indicative of a malfunction in the polishing process.

10. The wafer polishing apparatus of claim 9, wherein said robot means comprises a measurement robot arm having an operating range encompassing said unloading platform, said measurement site, said cleaning platform, said re-polishing platform, and said malfunction platform, said measurement robot arm for transferring the wafer directly from the unloading cassette to said measurement site where the wafer is analyzed, and for selectively transferring the wafer after analysis from said measurement site to any one of the cleaning standby cassette, the re-polishing standby cassette, and the malfunction standby cassette.

* * * * *